United States Patent [19]

Acocella

[11] Patent Number: 4,691,609

[45] Date of Patent: Sep. 8, 1987

[54] STYLUS PICK FOR STRINGED MUSICAL INSTRUMENTS

[75] Inventor: Richard A. Acocella, Boston, Mass.

[73] Assignee: Robert G. Rice, Sharon, Mass. ; a part interest

[21] Appl. No.: 941,226

[22] Filed: Dec. 9, 1986

[51] Int. Cl.[4] ..... G10D 3/16

[52] U.S. Cl. ..... 84/322; D17/20

[58] Field of Search ..... 84/322; D17/20

[56] References Cited

U.S. PATENT DOCUMENTS

| | | | |
|---|---|---|---|
| 842,920 | 2/1907 | Thedorf | 84/322 |
| 2,016,438 | 10/1935 | Kealoha | 84/322 |
| 2,481,759 | 9/1949 | Lawrence | 84/322 |

FOREIGN PATENT DOCUMENTS

| | | | |
|---|---|---|---|
| 400348 | 12/1923 | Fed. Rep. of Germany | 84/322 |

*Primary Examiner*—Lawrence R. Franklin

*Attorney, Agent, or Firm*—Salter & Michaelson

[57] ABSTRACT

A pick for stringed musical instruments comprises a substantially planar pick body and a stylus on the body having a conical tip portion which extends outwardly beyond the periphery of the body terminating in a point. The pick is adapted to facilitate the application of alternate picking techniques by reducing the criticality of precisely positioning the pick so that it contacts a string of an instrument at substantially the same angle and substantially the same picking depth on each picking stroke.

10 Claims, 5 Drawing Figures

STYLUS PICK FOR STRINGED MUSICAL INSTRUMENTS

BACKGROUND AND SUMMARY OF THE INVENTION

The instant invention relates to musical instruments and more particularly to an improved pick for playing stringed musical instruments, such as guitars and the like.

In recent years a picking technique known as "alternate picking" has become relatively popular among musicians who play stringed instruments, and in particular among guitarists. In this connection, alternate picking generally involves the application of relatively fast, short picking strokes wherein the tip of a pick is moved back and forth across a single string to produce a series of notes from the string in rapid succession. It has been found that this technique can be utilized for producing unique sounds which cannot normally be produced from guitars or other similar instruments utilizing conventional picking techniques. It has also been found that as music which is produced by alternate picking techniques has received increased exposure, the popularity of such music has increased dramatically. For example, both jazz and rock-and-roll music produced by musicians who are skilled in alternate picking techniques has been found to have a high level of popularity.

Unfortunately, while music which is produced by alternate picking techniques has achieved a high degree of popularity, it has been found that there are relatively few musicians who are capable of applying such techniques with a high degree of proficiency. This is primarily because alternate picking techniques require an extremely high level of skill due to the fact that it is very difficult for a guitarist to rapidly move the tip of a pick back and forth across a single string of an instrument in a uniform manner. In this regard, in order for a conventional pick to produce relatively uniform picking sounds from a string during the application of alternate picking techniques, it is generally necessary for the pick to meet the string at substantially the same angle on each up and down stroke, and it is also generally necessary for the pick be positioned at substantially the same depth with respect to the string during each stroke. Further, if the pick is inadvertently positioned at too great a depth relative to a string so that the pick cannot easily pass over the string, the pick can be stopped by the string so that the picking rhythm is interrupted. Hence, in order to effectively apply alternate picking techniques, a guitarist must be capable of effecting an extremely high degree of muscle control over his or her picking hand in order to assure that the pick meets the appropriate string at the correct angle and picking depth on each stroke. As a result, it has been found that alternate picking is a very difficult technique to master and that therefore there are very few musicians who are capable of applying this technique to produce high-quality sounds.

Heretofore alternate picking techniques have generally been performed utilizing conventional substantially flat guitar picks of generally rounded triangular configuration. In this regard, despite the above described difficulties which have made it extremely difficult for most guitarists to apply alternate picking techniques, heretofore there simply have not been other types of guitar picks which have been more suited for applying alternate picking techniques. Accordingly, heretofore most guitarists have used conventional picks despite their disadvantages.

Devices representing the closest prior art to the subject invention of which the applicant is aware are disclosed in the U.S. patents to Galetzky U.S. Pat. No. Des. 132,717; Burke U.S. Pat. No. Des. 257,151; Forney U.S. Pat. Nos. 756,348; Orth 1,444,982; Bay 2,234,224; Lawrence 2,481,759; Galetzky 3,319,505; Henley, Jr. 4,150,601; and Des Gaines 4,248,128. However, the devices disclosed in these references are generally less effective for applying alternate picking techniques than the above described substantially flat picks. Further, the above references fail to suggest the basic structural features of the guitar pick of the instant invention, and as a result, they are believed to be of only general interest with respect to the subject invention.

The pick of the instant invention substantially facilitates the application of alternate picking techniques by musicians, and hence it enables less-skilled musicians to effectively produce high-quality sounds in this manner. Specifically, the pick of the instant invention comprises a pick body which is adapted to be grasped between a thumb and a forefinger on a hand of a musician and a stylus on the pick body adjacent a peripheral edge thereof. The stylus includes a tip portion of substantially pointed conical configuration which projects outwardly beyond the peripheral edge of the body portion, terminating in a substantially pointed end. The conical tip portion is preferably formed so that it has an outer peripheral rim at its inner extremity, and the stylus preferably further comprises an inner portion which tapers inwardly toward the body from the peripheral rim. The tip portion preferably has an included interior angle of between 70° and 110°, although if is possible for the tip portion to be constructed so that it has an angle of between 20° and 160°. The body of the pick is preferably substantially planar, and it is preferably oriented so that it includes the conical axis of the tip portion. Further, the body is preferably formed with a tapered end of reduced width, and the stylus is preferably mounted on the tapered end of the body so that the peripheral rim of the stylus is spaced outwardly slightly beyond the periphery of the tapered end.

It has been found that the pick of the instant invention effectively eliminates many of the disadvantages of the heretofore available picks for stringed instruments. In particular, it has been found that by providing a pick having a stylus which has a tapered conical end portion, the pick can be more effectively utilized for performing alternate picking techniques. In this regard, since the conical tip portion has a substantially uniform configuration around its entire circumference, the angle at which the body portion of the pick is held when the pick engages a string of an instrument during the application of alternate picking techniques has very little significance with respect to the sound which is produced. Hence, when utilizing the pick of the subject invention, it is not necessary for a musician to hold the body portion at substantially the same angle during each upstroke and downstroke. Further, since the conical tip portion of the pick has a tapered outer surface, the depth to which the pick is inserted by a musician during the application of alternate picking techniques also has relatively little significance as long as the pick is inserted to a depth which causes the conical tip portion to engage the appropriate string. In this regard, the tapered configuration of the conical tip portion enables a string to slide along the surface of the tip portion toward the pointed end as long as the string engages some part of the tip portion. Hence the problem of inadvertently inserting the pick to a depth which causes the pick to be stopped rather than passing over the string is effectively eliminated.

In addition to the above, while the pick of the subject invention effectively eliminates many of the major drawbacks of the heretofore available guitar picks in connection with the use thereof for performing alternate picking techniques, the pick of the subject invention nevertheless retains features which enable it to be effectively utilized for producing high-quality sounds. Specifically, by providing a tip portion having a substantially pointed conical configuration, it is possible to produce a sharp, clear note with the pick of the instant invention each time it passes over a string. Further, by providing an outer peripheral rim on the inner end of the conical tip portion, it is also possible to utilize the pick for applying strumming techniques by drawing it back across several strings so that the peripheral rim passes over each of the strings.

Accordingly, it is a primary object of the instant invention to provide a pick for stringed instruments which facilitates the application of alternate picking techniques.

Another object of the instant invention is to provide a pick which is substantially unaffected by the angle at which it is held by a musician.

Another object of the instant invention is to provide a pick which effectively eliminates the adverse effects of inserting the pick to too great a depth.

An even further object of the instant invention is to provide a pick for a stringed instrument which has a conical tip portion.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
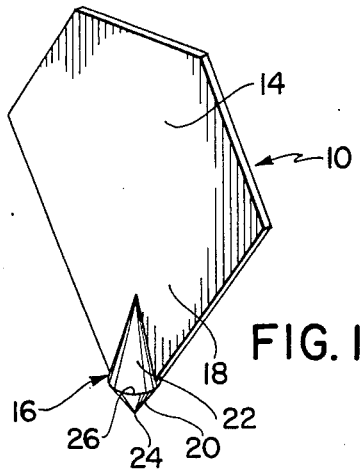
FIG. 1 is an enlarged perspective view of the pick of the instant invention.
Figure 2:
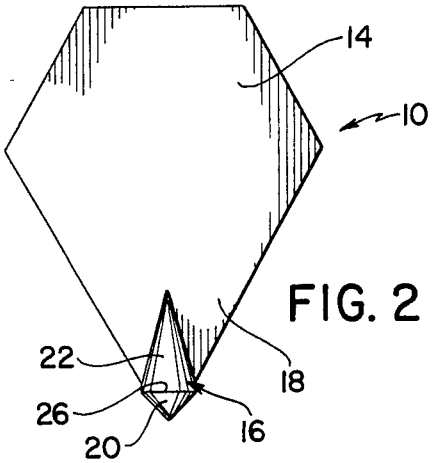
FIG. 2 is a front elevational view thereof.
Figure 3:
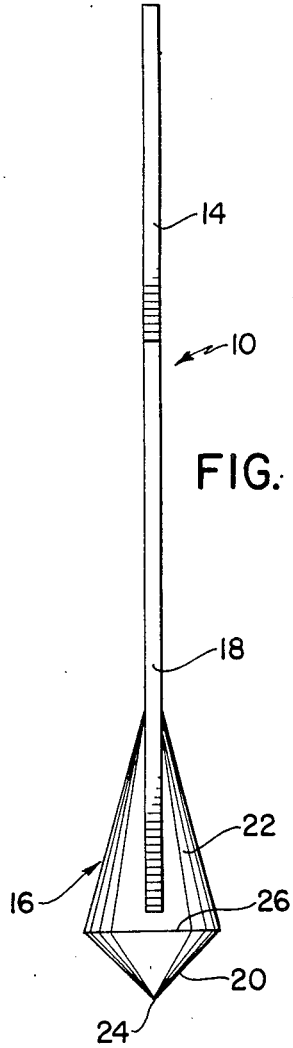
FIG. 3 is a further enlarged side elevational view thereof.
Figure 4:
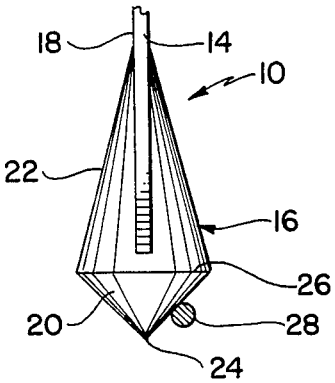
FIG. 4 is a similar fragmentary side elevational view of the pick as it is used to engage a string.
Figure 5:
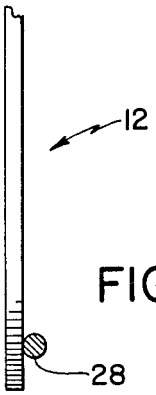
FIG. 5 is a side elevational view of a conventional pick as it is used to engage a string.

Referring now to the drawing, the pick for stringed instruments of the instant invention is illustrated in FIGS. 1 through 4 and generally indicated at 10, and a conventional substantially flat pick of the prior art is illustrated in FIG. 5 and generally indicated at 12. The pick 10 comprises a body 14 and a stylus 16, and it is particularly adapted for use in performing alternate picking techniques on stringed instruments such as guitars and the like.

The body 14 is preferably made of a suitable corrosion-resistant metal in a substantially flat planar configuration to enable it to be easily grasped between a thumb and forefinger of a musician. The body 14 preferably has a tapered end 18 of reduced width, and the stylus 16 is preferably integrally formed on the tapered end 18 so that it projects beyond the peripheral edge of the body 14. In the embodiment of the pick of the instant invention herein set forth, the perimeter of the body 14 is defined by a plurality of substantially straight sides which meet at substantially sharp corners. It will be understood, however, that the primary purpose of the body 14 is to provide an effective element which can be easily held by a musician and that therefore the body can be effectively formed in a variety of other peripheral configurations which are adapted to be easily grasped between the thumb and forefinger.

The stylus 16 comprises a conical tip portion 20 and a tapered inner portion 22. The conical tip portion preferably terminates in a pointed end 24 which is sharp to the extent that it defines a discrete terminal end of the tip portion 20 but not to the extent that it would normally cause damage to a string of an instrument. The inner extremity of the tip portion 20 is defined by a peripheral rim 26, and the inner portion 22 extends from the rim 26 to the tapered end portion 18 of the body 14. The stylus 16 is preferably mounted on the body 14 so that the peripheral rim 26 is spaced outwardly slightly beyond the periphery of the tapered end portion 18 as illustrated most clearly in FIGS. 2 through 4. Further, the stylus 16 is preferably mounted on the body 14 so that the plane of the body 14 includes the axis of the conical tip portion 20. The pick 10 is preferably constructed so that the tip portion 20 has an included interior angle (the angle between diametrically opposite wall portions thereof) of between approximately 20° and 160°, although it is most effective when this angle is between approximately 70° and 110° and the preferred angle is approximately 90°.

It has been found that when the pick 10 is constructed in the above manner, it can be effectively utilized for performing alternate picking techniques on various types of stringed instruments. Specifically, as illustrated in FIG. 4, when the conical tip portion 20 contacts a string 28, the conical configuration of the tip portion 20 causes the string 28 to pass along the surface of the tip portion 20 until it passes over the point end 24 whereupon a note is produced. As a result, the exact point in the outward extent of the tip portion 20 where the string 28 initially makes contact has very little effect, since the string 28 can pass along the surface of the tip portion 20 until it reaches the pointed end 24. In addition, because the tip portion 20 is of conical configuration, the relative angle between the body 14 and the string 28 when the tip portion 20 makes contact with the string 28 also has relatively little bearing on the quality of the sound which is produced when the pick 10 passes over the string 28. Further, because the stylus 16 is formed with a peripheral rim 26, it is also possible to perform strumming techniques with the pick 10 by drawing it sequentially back over a group of strings so that the rim 26 passes over the strings to produce strumming sounds therefrom.

The beneficial aspects of the pick 10 can be more fully appreciated by comparing the operation of the pick 10 with the operation of the conventional pick 12 illustrated in FIG. 5. As will be seen, when the pick 12 makes contact with a string 28, the string 28 must engage the pick 12 at the correct point on the pick 12 in order to produce the desired sounds. In this connection, if the string engages the pick 12 at a point which is too far in on the body of the pick 12, the pick 12 will be stopped by the string 28, and the musical sequence will be interrupted. On the other hand, if the string 28 engages the pick 12 at a point which is too close to the peripheral edge of the pick 12, a weak or improper sound will be produced. Accordingly, in order to produce consistent sounds with the pick 12, the string 28 must engage the pick 12 at substantially the same point each time the pick 12 is passed over the string 28. In addition, since the pick 12 is of planar configuration, it must always be positioned at substantially the same relative angle to the string 28 when it engages the string 28 in order to produce uniform sounds. In contrast, none of these problems are encountered with the pick 10, since the pick 10 can engage a string 28 at various different picking depths and at various different angles without altering the sounds which are produced when the string 28 passes over the pointed end 24.

It is seen, therefore, that the instant invention provides an effective pick for stringed instruments which overcomes many of the disadvantages of the heretofore available picks with respect to the use thereof for performing alternate picking techniques. In this regard, since the pick 10 does not require the same degree of precision as a conventional pick when performing alternate picking techniques, it can be utilized by less-experienced musicians to effectively perform musical compositions requiring alternate picking techniques. It can also be used as a training aid, and it can be utilized for performing strumming techniques. Accordingly, it is seen that the pick of instant invention represents a significant advancement in the musical art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A pick for a stringed musical instrument comprising a pick body adapted to be grasped between a thumb and forefinger of a musician and a stylus on said body adjacent a peripheral edge thereof, said stylus including a tip portion of substantially pointed conical configuration which projects outwardly beyond said peripheral edge terminating substantially in a point.

2. In the pick of claim 1, said tip portion further characterized as having an outer peripheral rim at the inner extremity thereof.

3. In the pick of claim 2, said stylus further comprising an inner portion which tapers inwardly toward said body for said rim.

4. In the pick of claim 1, said conical tip portion having an included interior angle of between approximately 20° and 160°.

5. In the pick of claim 1, said conical tip portion having an included interior angle of between approximately 70° and 110°.

6. In the pick of claim 1, said conical tip portion having an included interior angle of approximately 90°.

7. In the pick of claim 1, said body being substantially planar and being oriented so as to include the conical axis of said tip portion.

8. In the pick of claim 7, said tip portion further characterized as having an outer peripheral rim.

9. In the pick of claim 8, said body having a tapered end of reduced width, said stylus being mounted on said tapered end.

10. In the pick of claim 9, said peripheral rim being spaced outwardly slightly beyond the periphery of said tapered end.

* * * * *